US008501378B2

(12) United States Patent
Lee et al.

(10) Patent No.: US 8,501,378 B2
(45) **Date of Patent: *Aug. 6, 2013**

(54) ELECTROPHOTOGRAPHIC TONER AND METHOD OF PREPARING THE SAME

(75) Inventors: Jeong-hyun Lee, Suwon-si (KR); Yong-kyun Jung, Suwon-si (KR); Kyeong Pang, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 774 days.

This patent is subject to a terminal disclaimer.

(21) Appl. No.: 12/625,637

(22) Filed: Nov. 25, 2009

(65) Prior Publication Data

US 2010/0178604 A1 Jul. 15, 2010

(30) Foreign Application Priority Data

Jan. 15, 2009 (KR) ..... 10-2009-0003404

(51) Int. Cl.
*G03G 9/08* (2006.01)

(52) U.S. Cl.
USPC ..... 430/108.1; 430/108.24; 430/108.3; 430/108.4; 430/108.5; 430/108.8; 430/109.3; 430/110.4

(58) Field of Classification Search
USPC ..... 430/108.1, 108.24, 108.3, 108.4, 430/108.5, 108.8, 109.3, 110.4
See application file for complete search history.

(56) References Cited

U.S. PATENT DOCUMENTS

| | | | | |
|---|---|---|---|---|
| 5,283,147 | A * | 2/1994 | Johnston et al. | 430/108.23 |
| 5,286,592 | A * | 2/1994 | Johnston et al. | 430/108.23 |
| 8,227,161 | B2 * | 7/2012 | Shin et al. | 430/108.3 |
| 8,232,034 | B2 * | 7/2012 | Kang et al. | 430/108.1 |
| 8,298,740 | B2 * | 10/2012 | Kim et al. | 430/110.3 |
| 8,318,397 | B2 * | 11/2012 | Cheong et al. | 430/108.3 |
| 2005/0176853 | A1 * | 8/2005 | Hopper et al. | 523/333 |
| 2006/0115760 | A1 * | 6/2006 | Mitsuhashi et al. | 430/111.4 |
| 2006/0165989 | A1 * | 7/2006 | Takikawa et al. | 428/402.2 |
| 2007/0111128 | A1 * | 5/2007 | Patel et al. | 430/108.4 |
| 2007/0196758 | A1 * | 8/2007 | Sasaki et al. | 430/108.4 |
| 2008/0003514 | A1 * | 1/2008 | Shin et al. | 430/109.3 |
| 2008/0166649 | A1 * | 7/2008 | Moffat et al. | 430/108.8 |
| 2010/0009283 | A1 * | 1/2010 | Pang et al. | 430/124.1 |
| 2010/0143835 | A1 * | 6/2010 | Shin et al. | 430/110.3 |
| 2010/0151376 | A1 * | 6/2010 | Kim et al. | 430/108.7 |
| 2010/0167194 | A1 * | 7/2010 | Jeong et al. | 430/108.8 |

* cited by examiner

*Primary Examiner* — Hoa V Le
(74) *Attorney, Agent, or Firm* — Stanzione & Kim, LLP

(57) ABSTRACT

An electrophotographic toner includes a latex, a colorant, and a release agent, wherein G'(80) is in a range of about $2.0\times10^5$ Pa to about $3.0\times10^6$ Pa and G'(80)/G'(140) is in a range of about $2.0\times10^2$ to about $3.0\times10^3$, wherein in regard to a molecular weight distribution on a gel permeation chromatography (GPC) chromatogram, the molecular weight region of $1.0\times10^4$ g/mol or less of a tetrahydrofuran (THF)-soluble component of the electrophotographic toner is about 5% or less, and the molecular weight region of $1.0\times10^5$ g/mol or more of the THF-soluble component of the electrophotographic toner is in a range of about 5% to about 20%, where G'(80) and G'(140) respectively denote storage moduli of the electrophotographic toner at temperatures of 80° C. and 140° C. when a dynamic viscoelasticity according to a sine-wave vibration is measured at an angular velocity of 6.28 rad/sec and at a temperature increase rate of 2.0° C./min.

8 Claims, 2 Drawing Sheets

ELECTROPHOTOGRAPHIC TONER AND METHOD OF PREPARING THE SAME

CROSS-REFERENCE TO RELATED APPLICATIONS

This application claims priority under 35 U.S.C. §119(a) from Korean Patent Application No. 10-2009-0003404, filed on Jan. 15, 2009, in the Korean Intellectual Property Office, the disclosure of which is incorporated herein in its entirety by reference

BACKGROUND

1. Field of the Invention

The present general inventive concept relates to an electrophotographic toner and a method of manufacturing the same.

2. Description of the Related Art

In an electrophotographic process or an electrostatic recording process, a developer used to visualize an electrostatic image or an electrostatic latent image can be classified into a two-component developer formed of toner and carrier particles and a one-component developer formed of only toner. The one-component developer can be classified into a magnetic one-component developer and a nonmagnetic one-component developer. Fluidizing agents such as colloidal silica are often added to the nonmagnetic one-component developer to increase a fluidity of the toner. Typically, toner includes coloring particles obtained by dispersing a colorant such as carbon black or other additives in a latex.

Methods of preparing toner include pulverization and polymerization. In the pulverization method, the toner is obtained by melting and mixing synthetic resins with colorants and, if required, other additives, pulverizing the mixture and sorting the particles until particles of a desired size are obtained. In the polymerization method, a polymerizable monomer composition is manufactured by uniformly dissolving or dispersing various additives, such as a colorant, a polymerization initiator and, if required, a cross-linking agent and an antistatic agent, in a polymerizable monomer. Then, the polymerizable monomer composition is dispersed in an aqueous dispersive medium, which includes a dispersion stabilizer, using an agitator to shape minute liquid droplet particles. Subsequently, the temperature of the mixture is increased and suspension polymerization is performed to obtain polymerized toner having coloring polymer particles of a desired size.

In an imaging device, such as an electrophotographic device or an electrostatic recording device, an image is formed by exposing an image on a uniformly charged image bearing unit to form an electrostatic latent image thereon, attaching toner to the electrostatic latent image to form a toner image, transferring the toner image onto a transfer medium such as transfer paper or the like, and then fixing the toner image to the transfer member by any of a variety of methods, including heating, pressurizing, solvent steaming and the like. In most fixing processes, the transfer medium with the toner image disposed thereon passes through fixing rollers and pressing rollers, and the toner image is fused to the transfer medium by heat and pressure.

Images formed by an imaging apparatus such as electrophotocopier should satisfy the requirements of high precision and accuracy. Conventionally, toner used in an imaging apparatus is usually obtained by using the pulverization method. In the pulverization method, color particles having a large range of particle size distribution are formed. Hence, in order to obtain satisfactory developing properties, there is a need to sort the coloring particles obtained through the pulverization method according to particle size so as to reduce a toner particle size distribution. However, it is difficult to precisely control the particle size and the particle size distribution by using a conventional mixing/pulverizing process in the manufacture of a toner which is suitable for an electrophotographic process or an electrostatic recording process. Also, when preparing a fine particle toner, the toner preparation yield is adversely affected by the sorting process. In addition, there are limits to the change/adjustment of a toner design in order to obtain desirable charging and fixing properties. Accordingly, polymerized toner, the size of toner particles of which is easy to control and which does not need to undergo a complex manufacturing process such as sorting, has been highlighted recently.

When toner is prepared through the polymerization method, polymerized toner having a desired toner particle size and toner particle size distribution can be obtained without pulverizing or sorting.

However, even with polymerized toner, the toner still needs to have functional physical properties such as fixability and durability in order to obtain excellent printing performance and high image quality when printing. To develop such toners, thixotropy needs to be optimized.

SUMMARY

The present general inventive concept invention provides an electrophotographic toner and a method of manufacturing the same having optimized thixotropic properties.

The present general inventive concept invention also provides an electrophotographic toner which provides high printing performance and high image quality due to optimized thixotropic properties.

Additional features and/or utilities of the present general inventive concept will be set forth in part in the description which follows and, in part, will be obvious from the description, or may be learned by practice of the general inventive concept.

The present general inventive concept may be achieved by providing an electrophotographic toner including a latex, a colorant, and a release agent, wherein in regard to the electrophotographic toner, G'(80) is in a range of about $2.0\times10^5$ Pa to about $3.0\times10^6$ Pa and G'(80)/G'(140) is in a range of about $2.0\times10^2$ to about $3.0\times10^3$, wherein in regard to a molecular weight distribution on a gel permeation chromatography (GPC) chromatogram, a molecular weight region of $1.0\times10^4$ g/mol or less of a tetrahydrofuran (THF)-soluble component of the electrophotographic toner may be about 5% or less, and the molecular weight region of $1.0\times10^5$ g/mol or more of the THF-soluble component of the electrophotographic toner may be in a range of about 5% to about 20%, where G'(80) and G'(140) respectively denote storage moduli of the electrophotographic toner at temperatures of 80° C. and 140° C. when dynamic viscoelasticity according to a sine-wave vibration is measured at angular velocity of 6.28 rad/sec and at a temperature increase rate of 2.0° C./min.

A weight average molecular weight of the THF-soluble component of the electrophotographic toner may be in a range of about $6.0\times10^4$ to about $8.0\times10^4$ g/mol.

The amount of a THF-insoluble component of the electrophotographic toner may be in a range of about 5% to about 20%.

The electrophotographic toner may include sulfur (S), iron (Fe), and silicon (Si), wherein a [S]/[Fe] ratio may be in a range of about $5.0\times10^{-4}$ to about $5.0\times10^{-2}$ and a [Si]/[Fe] ratio may be in a range of about $5.0\times10^{-4}$ to about $5.0\times10^{-2}$, where [S], [Fe], and [Si] respectively denote the amounts of S, Fe, and Si measured by X-ray fluorescence spectrometry.

The electrophotographic toner may include Si and Fe, and each of the Si and Fe may be in a range of about 3 to about 30,000 ppm.

An acid value of the electrophotographic toner may be in a range of about 0.5 to about 10 mgKOH/g.

The releasing agent may include a mixture including a paraffin-based wax and an ester-based wax or an ester group-containing paraffin-based wax.

When the releasing agent includes a mixture including a paraffin-based wax and an ester-based wax, the amount of the ester-based wax may be in a range of about 5 to about 39 parts by weight % based on a total weight of the releasing agent.

A volume average particle diameter of the electrophotographic toner may be in a range of about 3 μm to about 8 μm.

An average circularity of the electrophotographic toner may be in a range of about 0.940 to about 0.990.

A volume average particle size distribution index (GSDv) of the electrophotographic toner may be about 1.30 or less, and a number average particle size distribution index (GSDp) of the electrophotographic toner may be about 1.30 or less.

The present general inventive concept may also be achieved by providing a method of preparing a toner, the method including preparing a mixed solution by mixing a primary latex particle, a colorant dispersion, and a releasing agent dispersion, preparing a primary agglomerated toner by adding an agglomerating agent to the mixed solution, and preparing a secondary agglomerated toner by coating the primary agglomerated toner with a secondary latex prepared by polymerizing at least one polymerizable monomer, wherein in regard to the electrophotographic toner, G'(80) is in a range of about $2.0\times10^5$ Pa to about $3.0\times10^6$ Pa and G'(80)/G'(140) is in a range of about $2.0\times10^2$ to about $3.0\times10^3$, wherein in regard to a molecular weight distribution on a GPC chromatogram, the molecular weight region of $1.0\times10^4$ g/mol or less of a THF-soluble component of the electrophotographic toner is about 5% or less, and the molecular weight region of $1.0\times10^5$ g/mol or more of the THF-soluble component of the electrophotographic toner is in a range of about 5% to about 20%, where G'(80) and G'(140) respectively denote storage moduli of the electrophotographic toner at temperatures of 80° C. and 140° C. when dynamic viscoelasticity according to a sine-wave vibration is measured at an angular velocity of 6.28 rad/sec and at a temperature increase rate of 2.0° C./min.

The primary latex particle may include polyester alone, a polymer formed by polymerizing at least one polymerizable monomer, or a mixture thereof.

The method may further include coating a tertiary latex formed by polymerizing at least one polymerizable monomer on the secondary agglomerated toner.

The at least one polymerizable monomer may include at least one selected from the group consisting of styrene-based monomers, acrylic acids, methacrylic acid, derivatives of (meth)acrylic acids, ethylenically unsaturated mono-olefines, halogenated vinyls, vinyl esters, vinyl ethers, vinyl ketones, and nitrogen-containing vinyl compounds.

The releasing agent dispersion may include a mixture including a paraffin-based wax and an ester-based wax or an ester group-containing paraffin-based wax.

The agglomerating agent may include a Si and Fe-containing metal salt.

The agglomerating agent may include polysilicate iron.

The present general inventive concept may also be achieved by providing an imaging method including forming a visible image by attaching toner to a surface of an image carrier on which a latent image is formed and transferring the visible image onto a transfer medium, wherein in regard to the electrophotographic toner, G'(80) is in a range of about $2.0\times10^5$ Pa to about $3.0\times10^6$ Pa and G'(80)/G'(140) is in a range of about $2.0\times10^2$ to about $3.0\times10^3$, wherein in regard to a molecular weight distribution on a GPC chromatogram, a molecular weight region of $1.0\times10^4$ g/mol or less of a THF-soluble component of the electrophotographic toner is about 5% or less, and a molecular weight region of $1.0\times10^5$ g/mol or more of the THF-soluble component of the electrophotographic toner is in a range of about 5% to about 20%, where G'(80) and G'(140) respectively denote storage moduli of the electrophotographic toner at temperatures of 80° C. and 140° C. when dynamic viscoelasticity according to a sine-wave vibration is measured at an angular velocity of 6.28 rad/sec and at a temperature increase rate of 2.0° C./min.

The present general inventive concept may also be achieved by providing a toner supplying unit including a toner tank to store toner, a supplying part projecting inside the toner tank to discharge the toner from the toner tank and a toner agitating member rotatably disposed inside the toner tank to agitate the toner in an inner space of the toner tank including a location on a top surface of the supplying part, wherein the toner includes the toner described above.

The present general inventive concept may also be achieved by providing an imaging apparatus including an image carrier, an image forming unit that forms an electrostatic latent image on a surface of the image carrier, a unit receiving a toner, a toner supplying unit that supplies the toner onto the surface of the image carrier to develop the electrostatic latent image on the surface of the image carrier into a toner image, and a toner transferring unit that transfers the toner image to a transfer medium from the surface of the image carrier wherein the toner includes the toner described above.

The present general inventive concept may also be achieved by providing an electrophotographic toner having toner particles, comprising a latex, a colorant, and a release agent, wherein the toner particles have a G'(80) is in a range of about $2.0\times10^5$ Pa to about $3.0\times10^6$ Pa and a G'(80)/G'(140) is in a range of about $2.0\times10^2$ to about $3.0\times10^3$, where G'(80) and G'(140) respectively denote storage moduli of the toner particles at temperatures of 80° C. and 140° C. when a dynamic viscoelasticity is measured at an angular velocity of 6.28 rad/sec and at a temperature increase rate of 2.0° C./min.

A molecular weight region of $1.0\times10^4$ g/mol or less of a tetrahydrofuran (THF)-soluble component of the toner particles may be about 5% or less.

A molecular weight region of $1.0\times10^5$ g/mol or less of a tetrahydrofuran (THF)-soluble component of the toner particles may be about 5% to about 20%.

BRIEF DESCRIPTION OF THE DRAWINGS

The above and/or other features and utilities of the present general inventive concept will become more apparent by describing in detail exemplary embodiments thereof with reference to the attached drawings in which.

DETAILED DESCRIPTION OF THE EMBODIMENTS

Figure 1:
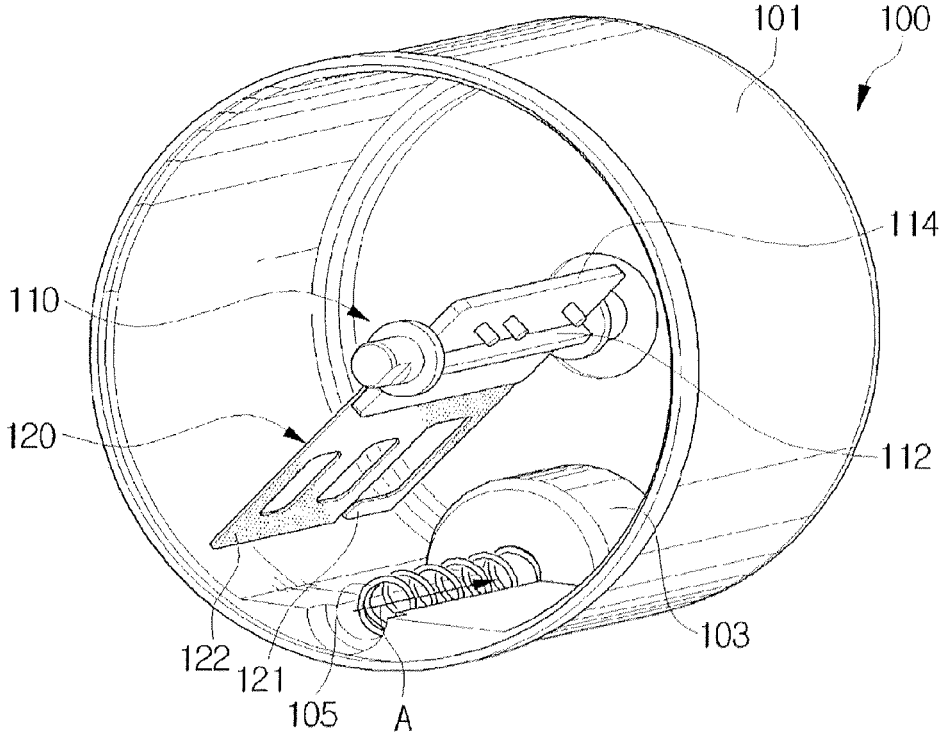
FIG. 1 is a perspective view illustrating a toner supplying unit according to an exemplary embodiment of the present general inventive concept.

The present general inventive concept will now be described more fully with reference to the accompanying drawings, in which exemplary embodiments of the present general inventive concept are illustrated, wherein like reference numerals refer to like elements throughout. The exemplary embodiments are described below in order to explain the present general inventive concept by referring to the figures.

An electrophotographic toner (also referred to as 'toner') according to an exemplary embodiment of the present general inventive concept includes a latex, a colorant, and a release agent, wherein in regard to the toner, G'(80) may be in a range of about $2.0\times10^5$ Pa to about $3.0\times10^6$ Pa and a ratio of G'(80)/G'(140) may be in a range of about $2.0\times10^2$ to about $3.0\times10^3$ Herein, G'(80) and G'(140) respectively denote storage moduli of the toner at temperatures of 80° C. and 140° C. when dynamic viscoelasticity according to a sine-wave vibration is measured at an angular velocity of 6.28 rad/sec and at a temperature increase rate of 2.0° C./min. In addition, G'(80)/G'(140) refers to a ratio of the storage moduli of the toner at 80° C. and the storage moduli of the toner at 140° C.

G'(80) and G'(80)/G'(140) are used to predict fusing-related characteristics of the toner. Herein, fusing-related characteristics may include a cold offset, a minimum fusing temperature (MFT), and a fusing latitude. However, the present general inventive concept is not limited thereto. That is, in alternative exemplary embodiments, the G'(80) and G'(80)/G'(140) may be used to predict various other fusing-related characteristics.

G'(80) and G'(140) may be obtained by measuring storage moduli at 80° C. and 140° C., respectively, and the storage modulus may be measured by using a circular disc-type rheometer having two angular speeds (for example, TA ARES) at an angular velocity of 6.28 rad/sec and at a temperature increase rate of 2.0° C./min.

The dynamic viscoelasticity of the toner may be dependent upon thermal properties (for example, glass transition temperature (Tg)) and a degree of cross-linkage of the toner, a dispersion property, a compatibility, a particle size distribution, and a material used. In particular, for G'(80), that is, viscoelasticity at a temperature equal to or lower than 100° C. is dependent upon Tg and Tm (melting temperature) of latex and wax, a type of agglomerating agent, and a colorant. In addition, for G'(140), that is, viscoelasticity at a temperature higher than 100° C. is dependent upon dispersion property inside toner particles, molecular weight, a degree of cross-linkage, a particle diameter distribution. That is, for G'(140), the viscoelasticity at a temperature larger than 100° C. may not be dependent on the thermal properties of the latex or the wax. Thus, G'(80) and G'(80)/G'(140) may be determined in consideration of properties of source materials of the latex, the colorant, the release agent, and the agglomerating agent which are used to prepare the toner, and physical properties of the prepared toner.

G'(80) of the toner may be, for example, in a range of about $2.0\times10^5$ Pa to about $3.0\times10^6$ Pa, about $2.5\times10^5$ Pa to about $2.5\times10^6$ Pa, or about $3.0\times10^5$ Pa to about $2.0\times10^6$ Pa. When G'(80) is less than about $2.0\times10^5$ Pa, elasticity of the toner is relatively low and thus, a blocking phenomenon may occur in a developing unit and/or high-temperature preservation characteristics may be degraded. On the other hand, when G'(80) is larger than about $3.0\times10^6$ Pa, elasticity of the toner is so large that a fixability of the toner may be degraded.

G'(80)/G'(140) of the toner may be, for example, in a range of about $2.0\times10^2$ to about $3.0\times10^3$ about $2.0\times10^2$ to about $2.5\times10^3$, or about $2.0\times10^2$ to about $2.3\times10^3$. If G'(80)/G'(140) is less than about $2.0\times10^2$, elasticity of the toner at a temperature of 80° C. is low and high-temperature preservation characteristics of the toner may be degraded, or elasticity of the toner at a temperature of 140° C. is too high, and thus, the toner may be insufficiently dissolved. On the other hand, if G'(80)/G'(140) is larger than about $3.0\times10^3$, elasticity of the toner at a temperature of 140° C. is too low, and thus, a stable image may not be obtained.

In regard to a molecular weight distribution measured using a gel permeation chromatography (GPC) chromatogram, for a tetrahydrofuran (THF)-soluble component of the toner, a molecular weight region of $1.0\times10^4$ g/mol or less may be, for example, about 5% or less, in a range of about 0.1% to about 5%, or in a range of about 0.3% to about 5%, and a molecular weight region of $1.0\times10^5$ g/mol or more may be, for example, in a range of about 5% to about 20%, about 6% to about 20%, or about 7% to about 20%.

In exemplary embodiments, a molecular weight region of $1.0\times10^4$ g/mol or less and a molecular weight region of $1.0\times10^5$ g/mol or more may be measured by integrating the molecular weight region of $1.0\times10^4$ g/mol and less or the molecular weight region of $1.0\times10^5$ g/mol or more on the GPC chromatogram, respectively.

If the molecular weight region of $1.0\times10^4$ g/mol or less is larger than about 5%, the anti-blocking property of the toner may be reduced, the toner may be fused and attached to a transfer member or an image bearing member or may be formed into a film, and an anti-document offset property may be degraded.

The molecular weight region of $1.0\times10^5$ g/mol or more may be, for example, in a range of about 5% to about 20%, about 6% to about 20%, or about 7% to about 20%. If the molecular weight region of $1.0\times10^5$ g/mol is less than about 5%, an anti-high temperature offset property of the toner may be degraded. On the other hand, if the molecular weight region of $1.0\times10^5$ g/mol is more than about 20%, when the toner melts, a shape of the toner may not be easily changed, fixability may be degraded, and a glossiness of the toner may be degraded.

The weight average molecular weight of the THF-soluble component of the toner may be, for example, in a range of about $6.0\times10^4$ to about $8.0\times10^4$ g/mol, about $6.0\times10^4$ to about $7.8\times10^4$ g/mol, or about $6.0\times10^4$ to about $7.7\times10^4$ g/mol. If the weight average molecular weight of the THF-soluble component of the toner is less than about $6.0\times10^4$ g/mol, a high-temperature offset may occur. On the other hand, if the weight average molecular weight of the THF-soluble component of the toner is larger than about $8.0\times10^4$ g/mol, a fixability and a glossiness of the toner may be degraded.

An amount of THF-insoluble component of the toner may be, for example, in a range of about 5% to about 20%, or about 10% to about 18%, based on 100% of the toner. If the amount of the THF-insoluble component of the toner is larger than about 20% based on 100% of the toner, a fixability and a glossiness of the toner may be degraded. Meanwhile, less than about 5% of the THF-insoluble component may not exist.

The toner may include sulfur (S), iron (Fe), and silicon (Si), wherein a [S]/[Fe] ratio is in a range of about $5.0\times10^{-4}$ to about $5.0\times10^{-2}$ and a [Si]/[Fe] ratio is in a range of about $5.0\times10^{-4}$ to about $5.0\times10^{-2}$, where [S], [Fe], and [Si] respectively denote amounts of S, Fe, and Si measured by X-ray fluorescence spectrometry. [S] corresponds to an amount of S contained in an S-containing compound that acts as a chain transfer agent to adjust a latex molecular distribution when the latex is prepared. Accordingly, if [S] is high, the molecular weight of the latex may be decreased too much and a new chain may be initiated. On the other hand, if [S] is low, a chain may continuously grow and thus a molecular weight of the latex may be increased.

[Fe] corresponds to an amount of Fe contained in an agglomerating agent which is used to agglomerate the latex, the colorant, and the releasing agent when the toner is being prepared. Thus, [Fe] may affect the agglomeration properties, particle distribution, and particle size of the agglomerated toner. In this regard, the agglomerated toner may be a precursor for preparing a final toner.

[Si] corresponds to a sum of an amount of polysilica contained in an agglomerating agent and an amount of silica that is added to secure a flowability of the toner. Thus, [Si] may affect the agglomeration properties, particle distribution, and particle size of the agglomerated toner and the flowability of the toner.

The [S]/[Fe] ratio may be, for example, in a range of about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$.

If the [S]/[Fe] ratio is less than about $5.0\times10^{-4}$, [S] is too low, and thus a molecular weight of the latex is increased, or [Fe] is too high and thus the agglomeration properties of agglomerated toner may be affected and/or charging properties may be degraded. On the other hand, if the [S]/[Fe] ratio is larger than about $5.0\times10^{-2}$, [S] is too high and thus the molecular weight of the latex is reduced and/or a strong unpleasant odor may be generated, or [Fe] is too low, and thus, the agglomeration properties of the agglomerated toner may be affected or charging properties may be degraded.

The [Si]/[Fe] ratio may be, for example, in a range of about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$.

If the [Si]/[Fe] ratio is less than about $5.0\times10^{-4}$, the amount of silica, which is used as an external additive, is too low, and thus a flowability of the toner may be degraded. On the other hand, if the [Si]/[Fe] ratio is larger than about $5.0\times10^{-2}$, an amount of an external additive silica is too high and thus, an inside of a printer used may be contaminated.

An acid value of the toner may be, for example, in a range of about 0.5 to about 10 mgKOH/g, about 1 to about 10 mgKOH/g, or about 3 to about 10 mgKOH/g. If the acid value of the toner is less than about 0.5 mgKOH/g, charging properties of the toner may be degraded. On the other hand, if the acid value of the toner is larger than about 10 mgKOH/g, the charging properties and high-temperature and high-humidity preservation characteristics of the toner may be easily changed according to surrounding environments.

The acid value of the toner may be measured in the following manner.

1 to 10 g of toner is added to a 200 ml flask, together with 100 ml of a mixed solution including THF and ethanol in a volume ratio of 12:3, and then, sufficiently dissolved for 10 hours by shaking. The resultant solution is titrated using a 0.1N KOH solution. In this regard, the equivalence point is determined by using a pH meter, and the acid value is measured by using the following equation:

$$\text{Acid Value}=V\times C\times 56.11/M$$

where V is a volume (ml) of KOH used for the titration, C is a concentration (N) of KOH, and M is a weight (g) of a Measurement sample.

A method of preparing an electrophotographic toner according to an exemplary embodiment of the present general inventive concept includes preparing a mixed solution by mixing a primary latex particle, a colorant dispersion, and a releasing agent dispersion, preparing a primary agglomerated toner by adding an agglomerating agent to the mixed solution, and preparing a secondary agglomerated toner by coating the primary agglomerated toner with a secondary latex prepared by polymerizing at least one polymerizable monomer, wherein in regard to the toner, G'(80) may be in a range of about $2.0\times10^5$ to about $3.0\times10^6$ Pa and G'(80)/G'(140) may be in a range of about $2.0\times10^2$ to about $3.0\times10^3$.

In regard to a molecular weight distribution on a GPC chromatogram, a molecular weight region of $1.0\times10^4$ g/mol or less of the THF-soluble component of the toner may be about 5% or less, and a molecular weight region of $1.0\times10^5$ g/mol or more of the THF-soluble component of the toner may be in a range of about 5% to about 20%.

G'(80) and G'(140) respectively denote storage moduli of the toner at temperatures of 80° C. and 140° C. when dynamic viscoelasticity according to a sine-wave vibration is measured at an angular velocity of 6.28 rad/sec and at a temperature increase rate of 2.0° C./min.

Exemplary embodiments of the agglomerating agent include sodium chloride (NaCl), magnesium chloride (MgCl2), MgCl2■$8H_{20}$, [Al2(OH)„Cl6-n]m (Al2($SO_4$)3■18H2O, polyaluminum chloride (PAC), polyaluminum sulfate (PAS), polyaluminum silicate sulfate (PASS), ferrous sulfate, ferric sulfate, ferric chloride, calcium hydroxide, calcium carbonate, and Si and Fe-containing metal salts. However, the agglomerating agent is not limited to these examples.

An amount of the agglomerating agent may be, for example, in a range of about 0.1 to about 10 parts by weight, about 0.5 to about 8 parts by weight, or about 1 to about 6 parts by weight, based on 100 parts by weight of a primary latex particle. If an amount of the agglomerating agent is less than about 0.1 parts by weight, the agglomeration effect may be decreased. On the other hand, if an amount of the agglomerating agent is larger than about 10 parts by weight, the toner may be less charged and the particle size distribution of the toner may be widened.

In a method of preparing an electrophotographic toner according to an exemplary embodiment of the present general inventive concept, the electrophotographic toner includes a Si and Fe-containing metal salt as an agglomerating agent. In the toner prepared using the Si and Fe-containing metal salt as an agglomerating agent, the amounts of Si and Fe may each be, for example, in a range of about 3 to about 30,000 ppm, about 30 to about 25,000 ppm, or about 300 to about 20,000 ppm. In this regard, if the amounts of Si and Fe are each less than about 3 ppm, no addition effects occur. On the other hand, if the amounts of Si and Fe are each larger than about 30,000 ppm, the toner may be less charged and an inside of the printer used may be contaminated.

In exemplary embodiments, the Si and Fe-containing metal salt may include, for example, polysilica iron. In particular, due to an increased ionic strength by adding the Si and Fe-containing metal salt and interparticular collisions, a size of the primary agglomerated toner may be increased. The Si and Fe-containing metal salt may be poly silica iron. Exemplary embodiments of the Si and Fe-containing metal may include model nos. PSI-025, PSI-050, PSI-075, PSI-100, PSI-200, and PSI-300 (manufactured by Suido Kiko Co.). Table 1 illustrates physical properties and compositions of PSI-025, PSI-050, PSI-075, PSI-100, PSI-200, and PSI-300.

TABLE 1

| Type | | PSI-025 | PSI-050 | PSI-085 | PSI-100 | PSI-200 | PSI-300 |
|---|---|---|---|---|---|---|---|
| Silicon/Fe mole ratio (Si/Fe) | | 0.25 | 0.5 | 0.85 | 1 | 2 | 3 |
| Main component concentration | Fe (wt %) | 5.0 | 3.5 | 2.5 | 2.0 | 1.0 | 0.7 |
| | $SiO_2$ (wt %) | 1.4 | 1.9 | 2.0 | 2.2 | | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or more | | | | | |
| Average molecular weight (Dalton) | | 500,000 | | | | | |
| External appearance | | Yellowish brown transparent liquid | | | | | |

Since a Si and Fe-containing metal salt may be used as an agglomerating agent in a method of preparing an electrophotographic toner, a particle size may be reduced and a particle shape may also be controlled According to an exemplary embodiment of the present general inventive concept, a volume average particle size distribution index of the toner may be, for example, about 3 μm to about 8 μm, about 4 to about 7.5 μm, or about 4.5 to about 7 μm, and an average circularity of the toner may be, for example, about 0.940 to about 0.990, about 0.945 to about 0.985, or about 0.950 to about 0.980. However, the present general inventive concept is not limited thereto.

In general, the smaller the toner particle size, the higher a resolution and quality of an image produced thereby. However, when a transfer speed and a cleansing force are taken into consideration, small toner particles are not appropriate. Thus, it is important to have an appropriate toner particle size which provides high resolution and high quality images and which may also be cleaned easily.

In exemplary embodiments, a volume average particle diameter of the toner may be measured by an electrical impedance analysis. However, the present general inventive concept is not limited thereto. That is, in alternative exemplary embodiments, the volume average particle diameter of the toner may be measured by various other methods known in the art.

If the volume average particle diameter of the toner is less than about 3 μm, an image bearing unit may not be cleaned well and a production yield may be decreased when mass-produced. In addition, the toner may be harmful to humans due to asbestos. On the other hand, if a volume average particle diameter of the toner is larger than about 8 μm, high resolution and high quality of an image may not be obtained, the toner may be non-uniformly charged, fixing characteristics of the toner may be degraded, and it may be difficult for a doctor blade to control a toner layer.

If an average circularity of the toner is less than about 0.940, an image developed on a transfer medium has a large thickness and thus toner consumption may be increased, voids between toner particles are too large and the image developed on the transfer medium may have an insufficient coverage ratio. Thus, in order to obtain a desired image concentration, more toner is required and toner consumption is increased. On the other hand, if an average circularity of the toner is larger than about 0.990, an excessive amount of toner may be supplied onto a development sleeve and thus the development sleeve may be non-uniformly coated with the toner.

The circularity of the toner may be measured using a flow particle image analyzer (FPIA)-3000 apparatus produced by SYSMEX Co., Inc., using the following Equation:

<Equation>

$$\text{Circularity}=2\times(\pi\times\text{area})^{0.5}/\text{circumference}$$

The circularity may be in a range of 0 to 1, and as the circularity approaches 1, the toner particle shape becomes more circular. That is, a toner particle having a spherical shape has a circularity of 1.

Meanwhile, a toner particle distribution coefficient may be a volume average particle size distribution index (GSDv) or a number average particle size distribution index (GSDp), which may be measured as follows:.

First, a toner particle diameter distribution may be obtained by using toner particle diameters measured using a Multisizer III (manufactured by Beckman Coulter Inc.). The toner particle diameter distribution is divided by predetermined particle diameter ranges (channels). With respect to the respective divided particle diameter ranges (channels), the cumulative volume distribution of toner particles and the cumulative number distribution of toner particles are measured, wherein, in each of the cumulative volume and number distributions, the particle size in each distribution is increased in a direction from the left to the right. A cumulative particle diameter at 16% of the respective cumulative distributions is defined as a volume average particle diameter D16v and a number average particle diameter D16p. Likewise, a cumulative particle diameter at 50% of the respective cumulative distributions is defined as a volume average particle diameter D50v and a number average particle diameter D50p. Likewise, a cumulative particle diameter at 84% of the respective cumulative distributions is defined as a volume average particle diameter D84v and a number average particle diameter D84p.

In this case, GSDv is defined as $(D84v/D16v)^{0.5}$, and GSDp is defined as $(D84p/D16p)^{0.5}$.

In this regard, the GSDv and GSDp are each, for example, about 1.30 or less, in a range of about 1.15 to about 1.30, or in a range of about 1.20 to about 1.25. If each of GSDv and GSDp exceeds about 1.30, particle diameters may be non-uniform. In the method of preparing a toner according to the present exemplary embodiment, the primary latex may be a polyester, a polymer prepared by polymerizing at least one polymerizable monomer, or a mixture thereof (hybrid). When the primary latex is a polymer, at least one polymerizable monomer may be polymerized together with a releasing agent, such as wax, in the polymerization process, or the polymer may be mixed with the releasing agent. However, the present general inventive concept is not limited thereto.

The polymerization process may be an emulsion polymerization distribution process. As a result of the emulsion polymerization distribution process, the primary latex particles may have a particle size of about 1 μm or less, for example, in a range of about 100 nm to about 300 nm or in the range of about 150 nm to about 250 nm. However, the present general inventive concept is not limited thereto.

The polymerizable monomer used herein may include at least one selected from the group consisting of styrene-based monomers such as styrene, vinyltoluene, or α-methylstyrene; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonirile, methacrylonirile, acrylamide, or methacrylamide; ethylenically unsaturated monoolefines such as ethylene, propylene, or butylene; halogenated vinyls such as vinyl chloride, vinylidene chloride, or vinyl fluoride; vinyl esters such as vinyl acetate or vinyl propionate; vinyl ethers such as vinylmethylether or vinylethylether; vinyl ketones such as vinylmethylketone or methylisoprophenylketone; and a nitrogen-containing vinyl compound such as 2-vinylpyridine, 4-vinylpyridine, or N-vinylpyrrolidone. However, the present general inventive concept is not limited thereto.

In exemplary embodiments, when the primary latex particle is manufactured, a polymerization initiator and a chain transfer agent may be further used to efficiently perform the polymerization process.

Exemplary embodiments of the polymerization initiator may include persulfates such as potassium persulfate or ammonium persulfate; azo compounds such as 4,4-azobis(4-cyano valeric acid), dimethyl-2,2'-azobis(2-methylpropionate), 2,2-azobis(2-amidinopropane)dihydrochloride, 2,2-azobis-2-methyl-N-1,1-bis(hydroxymethyl)-2-hydroxyethylpropioamide, 2,2'-azobis(2,4-dimethylvaleronirile), 2,2'-azobisisobutyronirile, or 1,1'-azobis(1-cyclohexancarbonirile); and peroxides such as methylethylperoxide, di-t-butylperoxide, acetylperoxide, dikumylperoxide, lauroylperoxide, benzoylperoxide, t-butylperoxy-2-ethyl hexanoate, di-isopropylperoxydicarbonate, or di-t-butylperoxyisophthalate. However, the present general inventive concept is not limited thereto. In addition, oxidation-reduction initiators prepared by combining these polymerization initiators and reductants may also be used as the polymerization initiator.

The chain transfer agent refers to a material that changes a type of a chain carrier when a chain reaction occurs. The chain transfer agent includes a material that induces new chain activity to be substantially weaker than the existing chain activity. Due to the chain transfer agent, the polymerization degree of polymerizable monomers may be reduced and a novel chain may be initiated. In exemplary embodiments, the molecular weight distributions of the toner may be controlled by the chain transfer agent.

An amount of the chain transfer agent may be, for example, in a range of about 0.1 to about 5 parts by weight, about 0.2 to about 3 parts by weight, or about 0.5 to about 2.0 parts by weight, based on 100 parts by weight of the at least one polymerizable monomer. If an amount of the chain transfer agent is less than about 0.1 parts by weight based on 100 parts by weight of the at least one polymerizable monomer, a molecular weight of a polymer is too high, and thus, the agglomeration effects may be degraded. On the other hand, if the amount of the chain transfer agent is larger than about 5 parts by weight based on 100 parts by weight of the at least one polymerizable monomer, a molecular weight of a polymer is too low, and thus, a fixing performance may be degraded.

Exemplary embodiments of the chain transfer agent include sulfur-containing compounds such as dodecanethiol, thioglycolic acid, thioacetic acid, or mercaptoethanol; phosphorous acid compounds such as a phosphorous acid or sodium phosphorous acid; hypophosphorous acid compounds such as a hypophosphorous acid or a sodium hypophosphorous acid; and alcohols such as methylalcohols, ethylalcohols, isopropylalcohols, or n-butylalcohols. However, the chain transfer agent is not limited to these materials.

In exemplary embodiments, the primary latex particle may further include a charge controller. The charge controller used in exemplary embodiments of the present general inventive concept may be a negatively charged charge controller or a positively charged charge controller. Exemplary embodiments of the negatively charged charge controller include an organic metal complex such as a chrominum-containing azo complex or a monoazo metal complex, or chelate compounds; metal-containing salicylic acid compounds wherein the metal may be chrominum, iron, or zinc; and organic metal complexes such as aromatic hydroxycarboxylic acids or aromatic dicarboxylic acid. However, the negatively charged charge controller may not be particularly limited thereto. That is, exemplary embodiments may include various other negatively charged charge controllers known in the art. In addition, the positively charged type charge control agent may be a modified product such as nigrosine and a fatty acid metal salt thereof and an onium salt including a quaternary ammonium salt such as tributylammonium 1-hydroxy-4-naphthosulfonate and tetrabutylammonium tetrafluoro borate. These charge control agents may be used alone or in combination of at least two. However, the present general inventive concept is not limited thereto.

The charge controller stably supports the toner on a development roller with an electrostatic force. Thus, by using the charge controller, stable and high charging speeds may be obtained.

The primary latex particle obtained as described above may be mixed with the colorant dispersion and the releasing agent dispersion to prepare a mixed solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer.

Among colorants used to prepare the colorant dispersion, the black colorant may be carbon black or aniline black. For color toner, at least one colorant selected from the group consisting of the cyan colorant, the magenta colorant, and the yellow colorant may be further used in addition to the black colorant.

The yellow colorant may be a condensation nitrogen compound, an isoindolinone compound, an anthraquine compound, an azo metal complex, or an alyl imide compound. Examples of the yellow colorant include C.I. pigment yellows 12, 13, 14, 17, 62, 74, 83, 93, 94, 95, 109, 110, 111, 128, 129, 147, 168, and 180. However, the present general inventive concept is not limited thereto.

Examples of the magenta colorant include condensation nitrogen compounds, anthraquine compounds, quinacridone compounds, base dye rate compounds, naphthol compounds, benzo imidazole compounds, thioindigo compounds, and perylene compounds. Specifically, examples of the magenta colorant include C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254. However, the present general inventive concept is not limited thereto.

Examples of the cyan colorant include copper phthalocyanie compounds and derivatives thereof, anthraquine compounds, and base dye rate compounds. Specifically, examples of the cyan colorant include C.I. pigment blues 1, 7, 15, 15:1, 15:2, 15:3, 15:4, 60, 62, and 66.

These colorants may be used alone or in combination, and may be selected in consideration of color, chroma, brightness, weather resistance, or dispersibility in toner.

An amount of the colorant used to prepare the colorant dispersion may be, for example, in a range of about 0.5 to about 15 parts by weight, about 1 to about 12 parts by weight, or about 2 to about 10 parts by weight, based on 100 parts by weight of the toner. If an amount of the colorant is less than 0.5 parts by weight based on 100 parts by weight of the toner, a sufficient coloring effect may not be obtained. On the other hand, if an amount of the colorant is larger than about 15 parts by weight based on 100 parts by weight of the toner, the toner manufacturing costs may be increased and thus a sufficient electrification quantity may not be obtained.

The emulsifier used to prepare the colorant dispersion may be any emulsifier that is known in the art. For example, the emulsifier may be an anionic reactive emulsifier, a non-ionic reactive emulsifier, or a mixture thereof. The anionic reactive emulsifier may be HS-10 (manufactured by Dai-ich kogyo Inc.) or Dawfax 2-A1 (manufactured by Rhodia Inc.). The non-ionic reactive emulsifier may be RN-10 (manufactured by Dai-ichi kogyo).

The releasing agent dispersion used in the method of preparing a toner may include a releasing agent, water, or an emulsifier.

The releasing agent enables the toner to be fixed to a final image receptor at a low fixing temperature and to have excellent final image durability and abrasion-resistance characteristics. Thus, characteristics of the toner are dependent upon a type and an amount of the releasing agent.

An available releasing agent may be, but is not limited to, polyethylene-based wax, polypropylene-based wax, silicon wax, paraffin-based wax, ester-based wax, carnauba wax, or metallocene wax. The melting point of the releasing agent may be, for example, in the range of about 50° C. to about 150° C. In exemplary embodiments, the releasing agent may be physically attached to the toner particles, but may not covalently bind to the toner particles. Such a releasing agent enables the toner to be fixed to a final image receptor at a low fixing temperature and to have excellent final image durability and abrasion-resistance characteristics.

An amount of the releasing agent may be in a range of about 1 to about 20 parts by weight, about 2 to about 16 parts by weight, or about 3 to about 12 parts by weight, based on 100 parts by weight of the toner. If an amount of the releasing agent is less than about 1 part by weight based on 100 parts by weight of the toner, low-temperature characteristics of the toner may be degraded and a fixing temperature range may be narrowed. On the other hand, if an amount of the releasing agent is larger than about 20 parts by weight based on 100 parts by weight of the toner, preservation characteristics may be degraded and the manufacturing costs associated therewith may be increased.

The releasing agent may be an ester group-containing wax. Examples of the ester group-containing wax include mixtures including ester-based wax and non-ester based wax; and an ester group-containing wax prepared by adding an ester group to a non-ester based wax. However, the present general inventive concept is not limited thereto.

Since an ester group has a high affinity with respect to the latex component of the toner, a wax may be uniformly present among the toner particles and the function of the wax is effectively exerted. Meanwhile, if only ester-based wax is used, excessive plasticizing reactions may occur. Thus, the inclusion of the non-ester based wax may result in a prevention of excessive plasticizing reactions due to a releasing reaction with the latex. Therefore, development characteristics of the toner may be maintained at appropriate levels for a long period of time.

Examples of the ester-based wax include esters of C15-C30 fatty acids and 1 to 5-valence alcohols, such as behenic acid behenyl, staric acid stearyl, stearic acid ester of pentaeritritol, or montanic acid glyceride. Also, if an alcohol component that forms ester is a monovalent alcohol, the number of carbon atoms may be in the range of about 10 to about 30, and if the alcohol component that forms ester is a polymeric alcohol, the number of carbon atoms may be in the range of about 3 to about 10.

The non-ester based wax may be polymethylene-based wax or paraffin-based wax.

Examples of the ester group-containing wax include mixtures including paraffin-based wax and ester based wax; and ester group-containing paraffin-based wax. Examples of the ester group-containing wax also include P-280, P-318, and P-319 (manufactured by Chukyo yushi Co., Ltd).

If the releasing agent is a mixture including paraffin-based wax and ester based wax, the amount of the ester-based wax of the releasing agent may be, for example, in the range of about 5 to about 39 weight %, about 7 to about 36 weight %, or about 9 to about 33 weight %, based on the total weight of the releasing agent.

If the releasing agent is an ester group-containing wax, the amount of the ester group is, for example, in the range of about 5 to about 39 weight %, about 7 to about 36 weight %, or about 9 to about 33 weight %, based on the total weight of the releasing agent. If the amount of the ester group is less than about 5 weight % based on the total weight of the releasing agent, the compatibility of the ester-based wax with the primary latex particle may be reduced. On the other hand, if the amount of the ester group is larger than about 39 weight % based on the total weight of the releasing agent, plasticizing characteristics of the toner are too strong, and thus, development characteristics of the toner may not be maintained for a long period of time.

Like the emulsifier used in the colorant dispersion, the emulsifier used in the releasing agent dispersion may be any emulsifier that is used in the art. Examples of the emulsifier used in the releasing agent dispersion may include an anionic reactive emulsifier, a non-ionic reactive emulsifier, and mixtures thereof. The anionic reactive emulsifier may be HS-10 (manufactured by Dai-ich kogyo Inc.), or Dawfax 2-A1 (manufactured by Rhodia Inc). The non-ionic reactive emulsifier may be RN-10 (manufactured by Dai-ichi kogyo Inc).

Due to the method described above, a molecular weight, $T_g$, and rheological characteristics of the primary latex particles may be appropriately controlled in such a way that the toner may be fixed at low temperature.

The primary latex particles, the colorant dispersion and the releasing agent dispersion as described above are mixed to obtain a mixed solution, and then, a agglomerating agent is added to the mixed solution, thereby preparing a agglomerated toner. For example, the primary latex particles, the colorant dispersion, and the releasing agent dispersion are mixed and then the agglomerating agent is added thereto at a pH in the range of 1 to 4, thereby preparing a primary agglomerated toner having a particle size of 2.5 μm or less. The primary agglomerated toner may act as a core. Then, a secondary latex is added thereto and then a pH of the system used is controlled to be in the range of 6 to 8. Then, when a particle size of the resultant is maintained constant for a predetermined time period, the temperature is increased to 90 to 98° C. and the pH is decreased to 5 to 6, thereby preparing a secondary agglomerated toner constituting a shell layer.

The agglomerating agent may include at least one salt selected from the group consisting of Si and Fe-containing metal salts. The Si and Fe-containing metal salts may include polysilica iron.

The secondary latex may be obtained by polymerizing the at least one polymerizable monomer as described above. The polymerization process may be an emulsion polymerization distribution process. As a result of the emulsion polymerization distribution process, the secondary latex particles may have a particle size of about 1 μm or less, for example, in the range of about 100 to about 300 nm. The secondary latex may also include wax, and the wax may be included in the secondary latex in the polymerization process.

Meanwhile, a tertiary latex prepared by polymerizing the at least one polymerizable monomer described above may be further coated on the secondary agglomerated toner.

By forming the shell layer using the secondary latex or tertiary latex, the toner obtains high durability and excellent preservation characteristics during shipping and handling. In this case, a polymerization inhibitor may be further added to prevent formation of new latex particles, and starved-feeding conditions may be used to appropriately coat a monomer mixed solution on the toner.

The obtained secondary agglomerated toner or tertiary agglomerated toner is filtered to isolate toner particles and the isolated toner particles are dried. Then, an external additive is added to the dried toner and the amount of charge applied is controlled, thereby obtaining a final dry toner.

The external additive may be silica or $TiO_2$. The amount of the external additive may be in the range of about 1.5 to about 7 parts by weight, or about 2 to about 5 parts by weight, based on 100 parts by weight of toner to which the external additive is not added. If the amount of the external additive is less than about 1.5 parts by weight based on 100 parts by weight of toner to which the external additive is not added, toner particles may attach to each other due to a agglomeration force and a caking phenomenon occurs, and the amount of charge applied is unstable. On the other hand, if the amount of the external additive is greater than about 7 parts by weight based on 100 parts by weight of toner to which the external additive is not added, the external additive may contaminate a roller.

An imaging method according to an embodiment of the present general inventive concept includes: attaching toner to a surface of an image bearing unit on which an electrostatic latent image is formed so as to form a visualized image; and transferring the visualized image onto a transfer medium, wherein in regard to the toner, G'(80) may be in the range of about $2.0\times10^5$ Pa to about $3.0\times10^6$ Pa and G'(80)/G'(140) may be in the range of about $2.0\times10^2$ to about $3.0\times10^3$, wherein in regard to a molecular weight distribution on a GPC chromatogram, the molecular weight region of $1.0\times10^4$ g/mol or less of the THF-soluble component of the toner may be about 5% or less, and the molecular weight region of $1.0\times10^5$ g/mol or more of the THF-soluble component of the toner may be in the range of about 5% to about 20%, where G'(80) and G'(140) respectively denote storage moduli of the toner at temperatures of 80° C. and 140° C. when dynamic viscoelasticity according to a sine-wave vibration is measured at an angular velocity of 6.28 rad/sec and at a temperature increase rate of 2.0° C./min.

A representative electrophotographic imaging process includes a series of processes of forming images on a receptor including charging, exposing to light, developing, transferring, fixing, cleaning, and erasing process operations.

In the charging process, a surface of an image bearing unit is charged with negative or positive charges, whichever is desired, by a corona discharge or a charge roller. In the light exposing process, an optical system, conventionally a laser scanner or an array of diodes, selectively discharges the charged surface of the image bearing unit in an image-wise manner corresponding to a final visual image formed on a final image receptor to form a latent image. Electromagnetic radiation that may be referred to as "light" includes infrared radiation, visible light, and ultraviolet radiation.

In the developing process, appropriate polar toner particles generally contact the latent image of the image bearing unit, and conventionally, an electrically-biased developer having identical potential polarity to the toner polarity is used. The toner particles move toward the image bearing unit and are selectively attached to the latent image by electrostatic electricity, and form a toner image on the image bearing unit.

In the transferring process, the toner image is transferred to the final image receptor from the image bearing unit, and sometimes, an intermediate transferring element is used when transferring the toner image from the image bearing unit to aid the transfer of the toner image to the final image receptor.

In the fixing process, the toner image of the final image receptor is heated and the toner particles thereof are softened or melted, thereby fixing the toner image to the final image receptor. In alternative exemplary embodiments, a method of fixing the toner on the final image receptor includes high pressure with or without an application of heat.

In the cleaning process, residual toner remaining on the image bearing unit is removed.

Finally, in the erasing process, charges of the image bearing unit are exposed to light of a predetermined wavelength band and are reduced to be substantially uniform and of low value, and thus the residue of the organic latent image is removed and the image bearing unit is prepared for a next imaging cycle.

A toner supplying unit according to an exemplary embodiment of the present general inventive concept includes a toner tank to store toner, a supplying part projecting inside the toner tank to discharge the toner from the toner tank, and a toner agitating member rotatably disposed inside the toner tank to agitate the toner in an inner space of the toner tank including a location on a top surface of the supplying part, wherein the toner is used to develop an electrostatic latent image and includes a latex, a colorant, and a releasing agent, wherein in regard to the toner, G'(80) may be in a range of about $2.0\times10^5$ Pa to about $3.0\times10^6$ Pa and G'(80)/G'(140) may be in a range of about $2.0\times10^2$ to about $3.0\times10^3$, wherein in regard to a molecular weight distribution on a GPC chromatogram, a molecular weight region of $1.0\times10^4$ g/mol or less of the THF-soluble component of the toner may be about 5% or less, and a molecular weight region of $1.0\times10^5$ g/mol or more of the THF-soluble component of the toner may be in a range of about 5% to about 20%, where G'(80) and G'(140) respectively denote storage moduli of the toner at temperatures of 80° C. and 140° C. when a dynamic viscoelasticity according to a sine-wave vibration is measured at an angular velocity of 6.28 rad/sec and at a temperature increase rate of 2.0° C./min.

FIG. 1 is a view illustrating a toner supplying apparatus 100 according to an exemplary embodiment of the present general inventive concept.

The toner supplying apparatus 100 includes a toner tank 101, a supplying part 103, a toner-conveying member 105, and a toner-agitating member 110.

The toner tank 101 stores a predetermined amount of toner and may be formed in a substantially hollow cylindrical shape.

The supplying part 103 is disposed at a bottom of an inside of the toner tank 101 and discharges the stored toner from the inside of the toner tank 101 to an outside of the toner tank 101. For example, the supplying part 103 may project from the bottom of the toner tank 101 to the inside of the toner tank 101 in a pillar shape with a semi-circular section. However, the present general inventive concept is not limited thereto. The supplying part 103 includes a toner outlet (not illustrated) to discharge the toner to an outer surface thereof.

The toner-conveying member 105 is disposed at a side of the supplying part 103 at the bottom of the inside of the toner tank 101. The toner-conveying member 105 may be formed in, for example, a coil spring shape. However, the present general inventive concept is not limited thereto. An end of the toner-conveying member 105 extends in an inside of the supplying part 103 so that when the toner-conveying member 105 rotates, the toner in the toner tank 101 is conveyed to the inside of the supplying part 103. The toner conveyed by the toner-conveying member 105 is discharged to the outside through the toner outlet.

The toner-agitating member 110 is rotatably disposed inside the toner tank 101 and forces the toner in the toner tank 101 to move in a radial direction. For example, when the toner-agitating member 110 rotates at a middle of the toner tank 101, the toner in the toner tank 101 is agitated to prevent the toner from solidifying. As a result, the toner moves down to the bottom of the toner tank 101 by its own weight. The toner-agitating member 110 includes a rotation shaft 112 and a toner agitating film 120. The rotation shaft 112 is rotatably disposed at a middle of the toner tank 101 and has a driving gear (not illustrated) coaxially coupled with an end of the rotation shaft 112 projecting from a side of the toner tank 101. Therefore, the rotation of the driving gear causes the rotation shaft 112 to rotate. Also, the rotation shaft 112 may have a wing plate 114 to help fix the toner agitating film 120 to the rotation shaft 112. The wing plate 114 may be formed to be substantially symmetric about the rotation shaft 112. The toner agitating film 120 has a width corresponding to an inner length of the toner tank 101. Furthermore, the toner agitating film 120 may be elastically deformable. For example, the toner agitating film 120 may bend toward or away from a projection disposed inside the toner tank 101, i.e., the supplying part 103.

Portions of the toner agitating film 120 may be cut off from the toner agitating film 120 toward the rotation shaft 112 to form a first agitating part 121 and a second agitating part 122. However, the present general inventive concept is not limited thereto. That is, in alternative exemplary embodiments the toner agitating film 120 may include additional agitating parts formed thereon.

An imaging apparatus according to an exemplary embodiment of the present general inventive concept includes an image carrier, an image forming unit that forms an electrostatic latent image on a surface of the image carrier, a unit receiving a toner, a toner supplying unit that supplies the toner onto the surface of the image carrier to develop the electrostatic latent image on the surface of the image carrier into a toner image, and a toner transferring unit that transfers the toner image to a transfer medium from the surface of the image carrier, wherein the toner includes a latex, a colorant, and a releasing agent, wherein in regard to the toner, G'(60) may be in a range of about $4.0\times10^7$ Pa to about $4.0\times10^8$ Pa, G'(60)/G'(80) may be in a range of about 100 to about 500, and G'(100, 140) may be in a range of about $3.0\times10^3$ Pa to about $1.5\times10^5$ Pa, where G'(60) and G'(80) respectively denote storage moduli of the toner at temperatures of 60° C. and 80° C. when a dynamic viscoelasticity according to a sine-wave vibration is measured at an angular velocity of 6.28 rad/sec and at a temperature increase rate of 2.0° C./min, and G'(100, 140) denotes a storage modulus of the toner in a temperature range of 100° C. and 140° C. when the dynamic viscoelasticity according to the sine-wave vibration is measured at an angular velocity of 6.28 rad/sec and at a temperature increase rate of 2.0° C./min.

Figure 2:
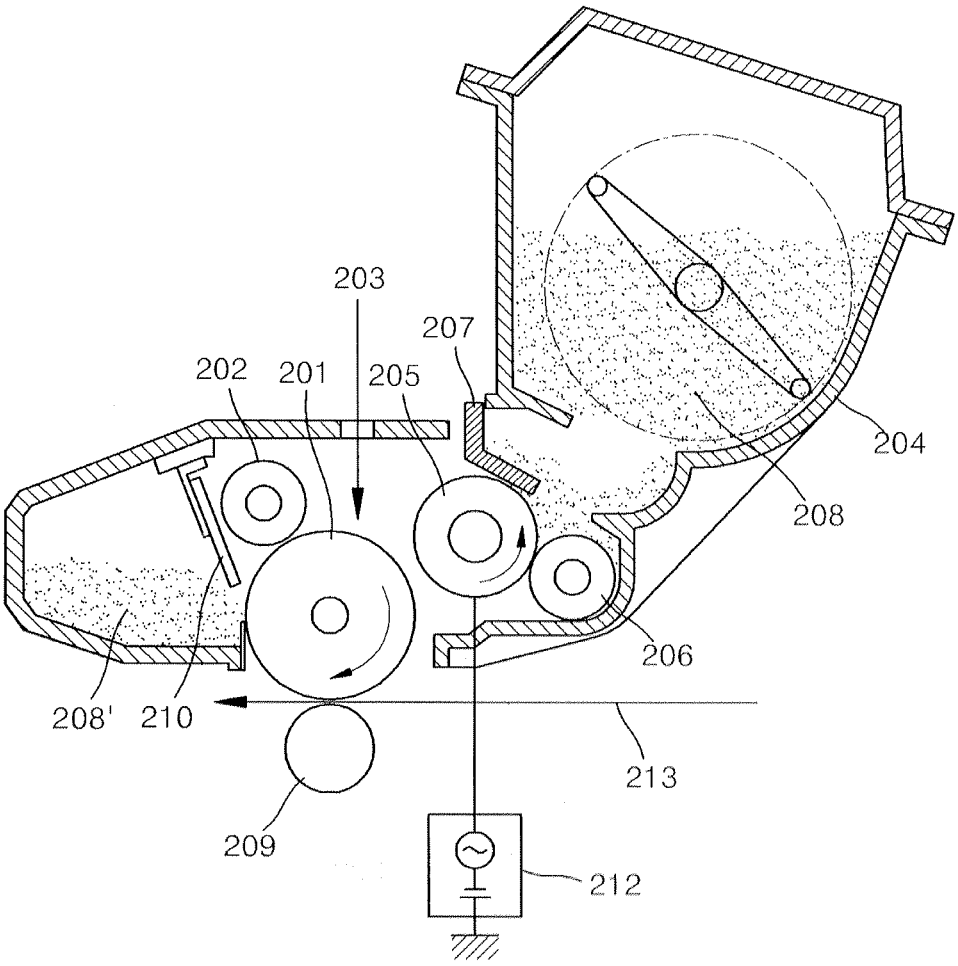
FIG. 2 is a cross-sectional schematic view illustrating an imaging apparatus including a toner, manufactured according to an exemplary embodiment of the present general inventive concept.

FIG. 2 is a cross-sectional schematic view of a non-contact development type imaging apparatus including toner prepared using a method according to an exemplary embodiment of the present general inventive concept.

A developer (for example, toner) 208 which includes a nonmagnetic one-component of a developing device 204 is supplied to a developing roller 205 by a supply roller 206 formed of an elastic material, such as polyurethane foam or sponge. The developer 208 supplied to the developing roller 205 reaches a contact portion between a developer controlling blade 207 and the developing roller 205 due to rotation of the developing roller 205. The developer controlling blade 207 may be formed of an elastic material, such as metal or rubber. When the developer 208 passes through the contact portion between the developer controlling blade 207 and the developing roller 205, the developer 208 is controlled and formed into a thin layer which has a uniform thickness and is sufficiently charged. The developer 208 which has been formed into a thin layer is transferred to a development region of a photoreceptor 201 that is an image carrier, in which a latent image is developed by the developing roller 205. At this time, the latent image is formed by scanning light 203 to the photoreceptor 201.

The developing roller 205 is separated from the photoreceptor 201 by a predetermined distance and faces the photoreceptor 201. The developing roller 205 rotates in a counterclockwise direction, and the photoreceptor 201 rotates in a clockwise direction.

The developer 208 which has been transferred to the development region of the photoreceptor 201 develops the latent image formed on the photoreceptor 201 by an electric force generated by a potential difference between a direct current (DC) biased alternating current (AC) voltage applied to the developing roller 205 and a latent potential of the photoreceptor 201 charged by a charging unit 202 so as to form a toner image.

The developer 208, which has been transferred to the photoreceptor 201, reaches a transfer unit 209 due to a rotation direction of the photoreceptor 201. The developer 208, which has been transferred to the photoreceptor 201, is transferred to a print medium 213 to form an image by the transfer unit 209 having a roller shape and to which a high voltage having a polarity opposite to the developer 208 is applied, or by corona discharging when the print medium 213 passes between the photoreceptor 201 and the transfer unit 209.

The image transferred to the print medium 213 passes through a high temperature and high pressure fusing device (not illustrated) and thus the developer 208 is fused to the print medium 213 to form the image. Meanwhile, a non-developed, residual developer 208' on the developing roller 205 is collected by the supply roller 206 to contact the developing roller 205, and the non-developed, residual developer 208' on the photoreceptor 201 is collected by a cleaning blade 210. The processes described above are repeated.

The one or more embodiments will be described in more detail with reference to the examples below, but are not limited thereto. These examples are for illustrative purposes only and are not intended to limit the scope of the one or more exemplary embodiments.

Scanning electron microscopic (SEM) images of toners prepared according to the following examples were obtained to identify shapes of the toners. The circularity of the toners may be measured using an FPIA-3000 apparatus produced by SYSMEX Co., Inc., using the equation below:

<Equation>

$$\text{Circularity}=2\times(\pi\times\text{area})^{0.5}/\text{circumference}.$$

The circularity may be in the range of 0 to 1, and as the circularity approaches 1, the toner particle shape becomes more circular.

EXAMPLE 1

Synthesis of Primary Latex Particles 1,000 g of a polymerizable monomer mixed solution (styrene/n-butyl acrylate weight ratio of 75.3/24.7), 33 g of b-carboxyethyl acrylate (Sipomer, Rhodia), 4.2 g of A-decanediol diacrylate as a crosslinker, 7.5 g of 1-dodecanethiol as a chain transfer agent (CTA), and 500 g of a sodium dodecyl sulfate (Aldrich) aqueous solution (2% in water) as an emulsifier were added to a 3 L beaker and the mixture was stirred to prepare a polymerizable monomer-emulsified solution. Separately, 18 g of ammonium persulfate (APS) as an initiator and 1,160 g of a sodium dodecyl sulfate (Aldrich) aqueous solution (0.13% with respect to water) as an emulsifier were added to a 3L double-jacketed reactor heated to a temperature of 75° C. While stirring the mixture including APS and sodium dodecyl sulfate, the prepared polymerizable monomer emulsified-solution was slowly dropped into the mixture for at least two hours. The reaction was performed for 8 hours at a reaction temperature to obtain primary latex particles. The particle size of the primary latex particles was measured by using a light scattering-type Horiba 910, and the average particle size measured was in a range of about 150 to about 200 nm. In this case, the toner concentration was 42.3%.

<Preparation of Colorant Dispersion>

10 g of the total weight of an anionic reactive emulsifier (HS-10;DAI-ICH KOGYO) and a nonionic reactive emulsifier (RN-10;DAI-ICH KOGYO) in ratios illustrated in Table 2 were added to a milling bath, together with 60 g of a colorant (black, cyan, magenta, or yellow), and then, 400 g of glass beads each having a diameter of about 0.8 to about 1 mm were added thereto and a milling operation was performed thereon at room temperature, thereby obtaining a dispersion. A homogenizer used in this experiment was an ultrasonic waves homogenizer (Sonic and materials, VCX750).

TABLE 2

| Color | Pigment Type | HS-10:RN-10 (weight ratio) | Particle diameter (Size) |
|---|---|---|---|
| Black | Mogul-L | 100:0 | 130 nm |
| | | 80:20 | 120 nm |
| | | 0:100 | 100 nm |
| Yellow | PY-84 | 100:0 | 350 nm |
| | | 50:50 | 290 nm |
| | | 0:100 | 280 nm |
| Magenta | PR-122 | 100:0 | 320 nm |
| | | 50:50 | 300 nm |
| | | 0:100 | 290 nm |
| Cyan | PB 15:4 | 100:0 | 130 nm |
| | | 80:20 | 120 nm |
| | | 80:30 | 120 nm |

<Agglomeration and Preparation of Toner>

30 g of a nitric acid (0.3 mol), and 15 g of 16% PSI-025 (manufactured by Suido Kiko Co.) as an agglomerating agent were added to a mixed solution, including 500 g of deionized water, 150 g of the primary latex particles constituting a core, 35 g of 19.5% cyan colorant dispersion (HS-10 100%), and 28 g of 35% P-420 (manufactured by Chukyo yushi Co., Ltd) (25~35% of paraffin wax, 5~10% of ester wax, and a melting point of 91.8° C.), in a 1L reactor, and then stirred using a homogenizer at a rate of 11,000 rpm for 6 minutes, thereby obtaining a primary agglomerated toner having a particle size of about 1.5 to about 2.5 μm. The resultant mixed solution was added to a 1L double-jacketed reactor and then the temperature was increased by 0.5° C. per minute from room temperature to 51.5° C. (a temperature equal to or higher than Tg-5 degree of latex). When a volume average diameter of the primary agglomerated toner reached about 5.8 μm, 50 g of a secondary latex obtained by polymerizing polystyrene-based polymerizable monomers was added thereto. When the volume average particle diameter of the reaction solution reached 6.0 μm, NaOH (1 mol) was added to the reaction solution to control the pH of the reaction solution to be 7. When the volume average particle diameter was maintained constant for 10 minutes, the temperature was increased to 96° C. at a rate of 0.5° C./min. When the temperature was 96° C., a nitric acid (0.3 mol) was added to the reaction solution to control the pH of the reaction solution to be 5.7. Then, the reaction was performed for 3 to 5 hours to obtain a secondary agglomerated toner having potato-like shaped particles and a particle size of about 5 to about 6 μm. Then, the agglomerated reaction solution was cooled to a temperature lower than Tg and then, a filtering operation was performed to isolate toner particles and the isolated toner particles were dried.

External additives were added to the toner by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles, and then, the mixture was stirred using a mixer (KM-LS2K, Daewha Tech) at a rate of 8,000 rpm for 4 minutes. The resultant toner had a volume average particle diameter of 5.9 μm. GSDp and GSDv of the final toner were 1.272 and 1.221, respectively. The average circularity of the final toner was 0.972.

EXAMPLE 2

Toner was prepared in the same manner as in Example 1, except that a yellow colorant was used instead of the cyan colorant. GSDp and GSDv of the toner were 1.271 and 1.226, respectively. The average circularity of the toner was 0.970.

EXAMPLE 3

Toner was prepared in the same manner as in Example 1, except that a magenta colorant was used instead of the cyan colorant. GSDp and GSDv of the toner were 1.267 and 1.214, respectively. The average circularity of the toner was 0.971.

EXAMPLE 4

Toner was prepared in the same manner as in Example 1, except that a cyan colorant was used instead of the cyan colorant. GSDp and GSDv of the toner were 1.265 and 1.221, respectively. The average circularity of the toner was 0.973.

COMPARATIVE EXAMPLE 1

Toner was prepared in the same manner as in Example 1, except that the primary agglomerated toner was synthesized using 15 g of 1-dodecanediol acting as a CTA. GSDp and GSDv of the toner were 1.260 and 1.213, respectively. The average circularity of the toner was 0.972.

COMPARATIVE EXAMPLE 2

Toner was prepared in the same manner as in Example 1, except that the primary agglomerated toner was synthesized using 8 g of A-decan diol diacrylate. GSDp and GSDv of the toner were 1.279 and 1.216, respectively. The average circularity of the toner was 0.970.

COMPARATIVE EXAMPLE 3

Toner was prepared in the same manner as in Example 1, except that the primary agglomerated toner was synthesized using 50 g of b-carboxyethyl acrylate (Sipomer, Rhodia). GSDp and GSDv of the toner were 1.509 and 1.312, respectively. The average circularity of the toner was 0.975.

COMPARATIVE EXAMPLE 4

KM-2300®, manufactured by Konica Minolta Co., Ltd, was used as a cyan toner.

Toner Evaluation

<Weight Average Molecular Weight and Molecular Weight Regions Measurement>

Weight average molecular weight (Mw) of a toner was measured by a GPC chromatogram (Waters 2414). A refractive index and multi-angle light scattering (MALS) were used as a detector, and three columns, Strygel HR 5, 4, and 2, were used.

In regard to a THF-soluble component of a toner, a molecular weight region of $1.0\times10^4$ g/mol or less and a molecular weight region of $1.0\times10^5$ g/mol or more were respectively measured by integrating the molecular weight region of $1.0\times10^4$ g/mol or less or the molecular weight region of $1.0\times10^5$ g/mol or more on a GPC chromatogram.

<Measurement of Amount of THF-Insoluble Component>

The THF-soluble component of a toner was measured by reduced-pressure filtering using a glass filter (Pore size: 40~100 μm), a filter paper, and a Celite (SIGMA-ALDRICH, celite 545).

<X-ray Fluorescence Measurement>

An X-ray fluorescence measurement of each of the samples was performed using an energy dispersive X-ray spectrometer (EDX-720, SHIMADZU Corp.). An X-ray tube voltage was 50 kV, and the amounts of samples that were molded were 3 g±0.01 g. For each sample, [S]/[Fe] and [Si]/[Fe] were calculated using intensities (unit: cps/uA) measured using quantitative results obtained by the X-ray fluorescence measurement.

<Thixotropical Characteristics Evaluation>

Thixotropical characteristics of a toner, that is, G'(80) and G'(140) were obtained by measuring storage moduli respectively measured at temperatures of 80° C. and 140° C. using an ARES measurement device that operates in sine-wave vibration at an angular velocity of 6.28 rad/sec and at a temperature increase rate of 2.0° C./min. In this regard, the ARES measurement device was manufactured by Rheometric Scientific Co., Ltd. The angular velocity, 6.28 rad/s, was set in consideration of a conventional fixing speed of a fixing device.

<Acid Value Measurement>

1 to 10 g of toner was added to a 200 ml flask together with 100 ml of a mixed solution including THF and ethanol in a volume ratio of 12:3 and then, sufficiently dissolved for 10 hours by shaking. The resultant solution was titrated using a 0.1N KOH solution. In this regard, the equivalence point was determined by using a pH meter, and the acid value is measured by using the following equation:

$$\text{Acid Value}=V\times C\times 56.11/M$$

where V is a volume (ml) of KOH used for the titration, C is a concentration (N) of KOH, and M is a weight (g) of a measurement sample.

<Fixing Characteristics Evaluation>

Apparatus: Belt-type fixing device (manufacturer: Samsung Electronics Co., Ltd, Product name: Color laser 660 fixing device)

Un-fixed image for test: 100% pattern

Test temperature: 100~200 (10° C. intervals)

Test paper sheet: 60 g of paper sheet (X-9 manufactured by Boise Co.) and 90 g of paper sheet (Exclusively manufactured by Xerox Co.)

Fixing speed: 160 mm/sec, 80 mm/sec

Fixing time: 0.08 to 0.16 seconds

This experiment was performed under the conditions described above, and then fixability of the fixed image was evaluated in the following manner.

Optical density (OD) of the fixed image was measured and then, a 3M 810 tape was attached to the fixed image and 500 g of weight was reciprocated thereon five times and the tape used was removed. Then, OD of the fixed image was measured.

fixability(%)=(after peeling off the OD_tape/before peeling off the OD_tape)×100

A fixing temperature region in which the fixability was 90% or more is regarded as a toner fixing region.

MFT: a minimum temperature at which the fixability is 90% or more without occurrence of cold-offset Hot offset temperature (HOT): a minimum temperature at which hot offset occurs <Gloss Evaluation>

This experiment was performed using a glossmeter (manufacturer: BYK Gardner, and product name: micro-TRI-gloss) at a temperature of 160° C. which is the temperature at which the fixing device was used.

Measurement angle: 60°

Measurement pattern: 100% pattern

Evaluation standard

◎: 6% or more

○: 4~6%

Δ: 2~4%

X: 2% or less

<High-Temperature High-Humidity Preservation Characteristics Evaluation>

External additives were added to 100 g of a toner and then the resultant toner was loaded into a developing unit (manufacturer: Samsung Electronics Co., Ltd, Product name: Color laser 660 fixing device) and preserved in a constant-temperature and constant-humidity oven under the following conditions while being packaged.

23° C., 55% relative humidity (RH) for 2 hours

=>40° C., 90% RH for 48 hours

=>50° C., 80% RH for 48 hours

=>40° C., 90% RH for 48 hours

=>23° C., 55% RH for 6 hours

After preserved under the conditions described above, it was identified with the naked eye whether toner caking occurred in the developing unit, and a 100% image was output to evaluate image defects.

Evaluation Standard

◎: no migration, no-caking

○: migration occurred but disappeared within 30 sheets of paper, no-caking

Δ: migration occurred and continued even after 30 sheets of paper, no-caking

X: caking occurred

<Toner Charging Characteristics Evaluation>

28.5 g of a carrier (SS82 manufactured by PTK Co., 35 μm), and 1.5 g of toner were added to 60 ml of a glass container and then the mixture was stirred using a turbula mixer. The amount of toner charged was measured by electric field separation.

Toner charging stability with respect to a mixing hour at room temperature and room humidity, and the amount of toner charged at high-temperature and high-humidity/the amount of toner charged at low-temperature and low-humidity ratio were used for evaluation high-temperature and high-humidity (HH): 32° C., RH 80% low-temperature and low-humidity (LL): 10° C., RH 10%

* Charging Stability.

○: A charging saturation curve with respect to a mixing hour is smooth and, after saturation charging, the change is negligible.

Δ: A charging saturation curve with respect to a mixing hour is slightly non-uniform, or after saturation charging, a small change occurred (maximum 30%).

X: Charging with respect to a mixing hour is not saturated, or after saturation charging, a significant change occurred (30% or more).

* HH/LL ratio.

◎: 0.7 or more

○: 0.55 or more

Δ: 0.45~0.55

X: less than 0.45

Evaluation of Streaks

A 500-sheet durability test was performed under the 20 page per minute (PPM) and 0% operating condition using a color laser printer, such as a fixing device as Color Laser 660 Model sold by Samsung Co., Ltd., Korea. To determine the occurrence or nonoccurrence of streaks, the image was evaluated based on whether transfer medium (ex. printing paper) was contaminated or not. The state of contamination and any influence on the image due to the contamination were visually observed to evaluate according to the following criteria:

○: Contamination is little observed, and no image defects occurred at all;

Δ: Contamination is somewhat observed, but does not affect images; and

X: Severe contamination is observed, and adversely affects images.

The evaluations described above were performed on each of the toners manufactured according to Examples 1 through 4 and Comparative Examples 1 through 4. The results are shown in Table 3.

TABLE 3

| | G'(80) | G'(80)/G'(140) | Molecular weight regions: $1.0 \times 10^4$ g/mol or less (%) | Molecular weight regions: $1.0 \times 10^5$ g/mol or more (%) | Average weight molecular weight of THF-soluble component | Amount of THF-insoluble component (%) | [Si]/[Fe] | [S]/[Fe] | Acid value (mgKOH/g) |
|---|---|---|---|---|---|---|---|---|---|
| Ex. 1 | $6.8 \times 10^5$ | $8.5 \times 10^2$ | 0.8 | 15 | $7.2 \times 10^4$ | 12 | $1.0 \times 10^{-2}$ | $8.3 \times 10^{-4}$ | 9 |
| Ex. 2 | $5.2 \times 10^5$ | $7.8 \times 10^2$ | 1 | 10 | $6.8 \times 10^4$ | 11 | $8.0 \times 10^{-3}$ | $8.8 \times 10^{-4}$ | 7 |
| Ex. 3 | $8.3 \times 10^5$ | $1.23 \times 10^3$ | 0.5 | 20 | $7.4 \times 10^4$ | 15 | $7.5 \times 10^{-3}$ | $7.2 \times 10^{-4}$ | 10 |
| Ex. 4 | $9.7 \times 10^5$ | $6.6 \times 10^2$ | 2 | 18 | $7.0 \times 10^4$ | 16 | $1.2 \times 10^{-2}$ | $1.0 \times 10^{-3}$ | 8 |
| Com. Ex. 1 | $7.8 \times 10^5$ | $2.25 \times 10^3$ | 10 | 4 | $4.0 \times 10^4$ | 8 | $9.3 \times 10^{-3}$ | $6.0 \times 10^{-4}$ | 7 |
| Com. Ex. 2 | $3.0 \times 10^5$ | $3.7 \times 10^2$ | 0.5 | 20 | $8.0 \times 10^4$ | 18 | $8.8 \times 10^{-3}$ | $4.0 \times 10^{-2}$ | 9 |
| Com. Ex. 3 | $6.9 \times 10^5$ | $5.9 \times 10^2$ | 1 | 10 | $7.2 \times 10^4$ | 10 | $9.8 \times 10^{-3}$ | $1.1 \times 10^{-3}$ | 10 |
| Com. Ex. 4 | $1.8 \times 10^5$ | $3.56 \times 10^3$ | 5.5 | 0 | $6.2 \times 10^4$ | 4 | 0 | 0 | 23 |

| | Gloss | Fixing characteristics: 160 mm/s MFT (90 g of paper sheet) | Fixing characteristics: 80 mm/s HOT (60 g of paper sheet) | Charging characteristics: Stability HH | Charging characteristics: Stability LL | Charging characteristics: HH/LL | Streaks | High-temperature high-humidity preservation characteristics |
|---|---|---|---|---|---|---|---|---|
| Ex. 1 | ◎ | ○ | ◎ | ○ | ○ | ◎ | ○ | ◎ |
| Ex. 2 | ◎ | ○ | ◎ | ○ | ○ | ◎ | ○ | ◎ |
| Ex. 3 | ◎ | ○ | ◎ | ○ | ○ | ◎ | ○ | ◎ |
| Ex. 4 | ◎ | ○ | ◎ | ○ | ○ | ◎ | ○ | ◎ |
| Com. Ex. 1 | ◎ | ○ | Δ | ○ | ○ | ◎ | ○ | Δ |
| Com. Ex. 2 | Δ | ○ | ○ | ○ | ○ | ◎ | ○ | ◎ |

TABLE 3-continued

| | | | | | | | | |
|---|---|---|---|---|---|---|---|---|
| Com. Ex. 3 | ◎ | ○ | ◎ | ○ | ○ | Δ | ○ | Δ |
| Com. Ex. 4 | Δ | ○ | Δ | ○ | ○ | ○ | Δ | X |

Referring to Table 3, in regard to the toners manufactured according to Examples 1 through 4, that is, when G'(80) was in the range of about $2.0\times10^5$ Pa to about $3.0\times10^6$ Pa and G'(80)/G'(140) was in the range of about $2.0\times10^2$ to about $3.0\times10^3$, the molecular weight region of $1.0\times10^4$ g/mol or less of the THF-soluble component was about 5% or less, and the molecular weight region of $1.0\times10^5$ g/mol or less of the THF-soluble component was in the range of about 5% to about 20%, gloss characteristics, fixing properties, charging properties, and high-temperature preservation characteristics all were excellent.

However, in regard to the toner manufactured according to Comparative Example 1, that is, when the low molecular weight region of $1.0\times10^4$ g/mol or less and the high molecular weight region of $1.0\times10^5$ g/mol were respectively outside the ranges, and an average weight molecular weight was low, anti-HOT offset and HH preservation characteristics were degraded. In regard to the toner manufactured according to Comparative Example 2, that is, when the low molecular weight region of $1.0\times10^4$ g/mol or less and the high molecular weight region of $1.0\times10^5$ g/mol were outside their respective upper limits, gloss characteristics and fixing properties were degraded. In regard to the toner manufactured according to Comparative Example 3, that is, when the acid value was higher than 10 mgKOH/g, HH/LL and HH preservation characteristics, which are charging properties, were degraded. In regard to the toner manufactured according to Comparative Example 4, that is, when G'(80), that is, a storage modulus at a temperature of 80° C. was less than about $2.0\times10^5$, high-temperature preservation characteristics were degraded.

While a few exemplary embodiments of the present general inventive concept have been shown and described, it will be understood by those of ordinary skill in the art that various changes in form and details may be made therein without departing from the principles and spirit of the present general inventive concept, the scope of which is defined in the appended claims and their equivalents.

The invention claimed is:

1. An electrophotographic toner comprising:

a latex;

a colorant; and a release agent, wherein in regard to the electrophotographic toner, G'(80) is in a range of about $2.0\times10^5$ Pa to about $3.0\times10^6$ Pa and G'(80)/G'(140) is in a range of about $2.0\times10^2$ to about $3.0\times10^3$, wherein in regard to a molecular weight distribution on a gel permeation chromatography (GPC) chromatogram, a molecular weight region of $1.0\times10^4$ g/mol or less of a tetrahydrofuran (THF)-soluble component of the electrophotographic toner is about 5% or less, and a molecular weight region of $1.0\times10^5$ g/mol or more of the THF-soluble component of the electrophotographic toner is in a range of about 5% to about 20%, where G'(80) and G'(140) respectively denote storage moduli of the electrophotographic toner at temperatures of 80° C. and 140° C. when dynamic viscoelasticity according to a sine-wave vibration is measured at an angular velocity of 6.28 rad/sec and at a temperature increase rate of 2.0° C/min, the electrophotographic toner comprises Si and Fe, and each of the Si and Fe is in the range of about 3 to about 30,000 ppm, wherein the releasing agent comprises a mixture comprising a paraffin-based wax and an ester-based wax, and an amount of the ester-based wax is in a range of about 5 to about 39% by weight based on a total weight of the releasing agent.

2. The electrophotographic toner of claim 1, wherein a weight average molecular weight of the THF-soluble component of the electrophotographic toner is in the range of about $6.0\times10^4$ to about $8.0\times10^4$ g/mol.

3. The electrophotographic toner of claim 1, wherein the amount of a THF-insoluble component of the electrophotographic toner is in a range of about 5% to about 20%.

4. The electrophotographic toner of claim 1, wherein the electrophotographic toner comprises sulfur (S), iron (Fe), and silicon (Si), wherein a [S]/[Fe] ratio is in a range of about $5.0\times10^{-4}$ to about $5.0\times10^{-2}$ and a [Si]/[Fe] ratio is in a range of about $5.0\times10^{-4}$ to about $5.0\times10^{-2}$, where [S], [Fe], and [Si] respectively denote the amounts of S, Fe and Si measured by X-ray fluorescence spectrometry.

5. The electrophotographic toner of claim 1, wherein an acid value of the electrophotographic toner is in a range of about 0.5 to about 10 $mg_{KOH/g}$.

6. The electrophotographic toner of claim 1, wherein a volume average particle diameter of the electrophotographic toner is in a range of about 3 μm to about 8 μm

7. The electrophotographic toner of claim 1, wherein an average circularity of the electrophotographic toner is in a range of about 0.940 to about 0.990.

8. The electrophotographic toner of claim 1, wherein a volume average particle size distribution index (GSDv) of the electrophotographic toner is about 1.30 or less, and a number average particle size distribution index (GSDp) of the electrophotographic toner is about 1.30 or less.

* * * * *